US005238646A

United States Patent [19]

Tarcy et al.

[11] Patent Number: 5,238,646

[45] Date of Patent: * Aug. 24, 1993

[54] METHOD FOR MAKING A LIGHT METAL-RARE EARTH METAL ALLOY

[75] Inventors: Gary P. Tarcy, Pittsburgh; Thomas M. Gavasto, New Kensington; Rebecca K. Wyss, Plum Boro; T. David Burleigh, Murrysville, all of Pa.

[73] Assignee: Aluminum Company of America, Pittsburgh, Pa.

[ * ] Notice: The portion of the term of this patent subsequent to Aug. 6, 2008 has been disclaimed.

[21] Appl. No.: 653,725

[22] Filed: Feb. 11, 1991

Related U.S. Application Data

[63] Continuation-in-part of Ser. No. 291,505, Dec. 29, 1988, Pat. No. 5,037,608, and a continuation-in-part of Ser. No. 365,840, Jun. 14, 1989, Pat. No. 5,059,390.

[51] Int. Cl.[5] ..... C22C 1/02

[52] U.S. Cl. ..... 420/405; 420/542; 420/590

[58] Field of Search ..... 75/315, 959; 420/405, 420/528, 590, 542

[56] References Cited

U.S. PATENT DOCUMENTS 3,503,738 3/1970 Cooper ..... 420/528

5,037,608 8/1991 Tarcy et al. ..... 420/405

5,059,390 10/1991 Burleigh et al. ..... 420/405

FOREIGN PATENT DOCUMENTS 873692 11/1983 U.S.S.R. .

*Primary Examiner*—Melvyn J. Andrews

*Attorney, Agent, or Firm*—Gary P. Topolosky; Daniel A. Sullivan, Jr.

[57] ABSTRACT

A method for making a light metal-rare earth metal alloy comprises adding a pellet to a substantially flux-free bath of molten light metal, said pellet including a mixture of rare earth metal-containing compound and one or more light metal powders. On a preferred basis, such mixtures comprise scandium oxide, up to about 10 wt. % aluminum powder and a substantial majority of magnesium powder, all of which are substantially similar in median particle size. This mixture is preferably compacted under a pressure of about 7 kpsi or more, then added to a bath of molten magnesium or molten aluminum to make magnesium-scandium, magnesium-aluminum-scandium, or aluminum-magnesium-scandium alloys therefrom. There is further disclosed a method for making an alloy containing about 7–12 wt. % lithium, about 2–7 wt. % aluminum, about 0.4–2 wt. % scandium, up to about 2 wt. % zinc and up to about 1 wt. % manganese, the balance magnesium and impurities.

28 Claims, 1 Drawing Sheet

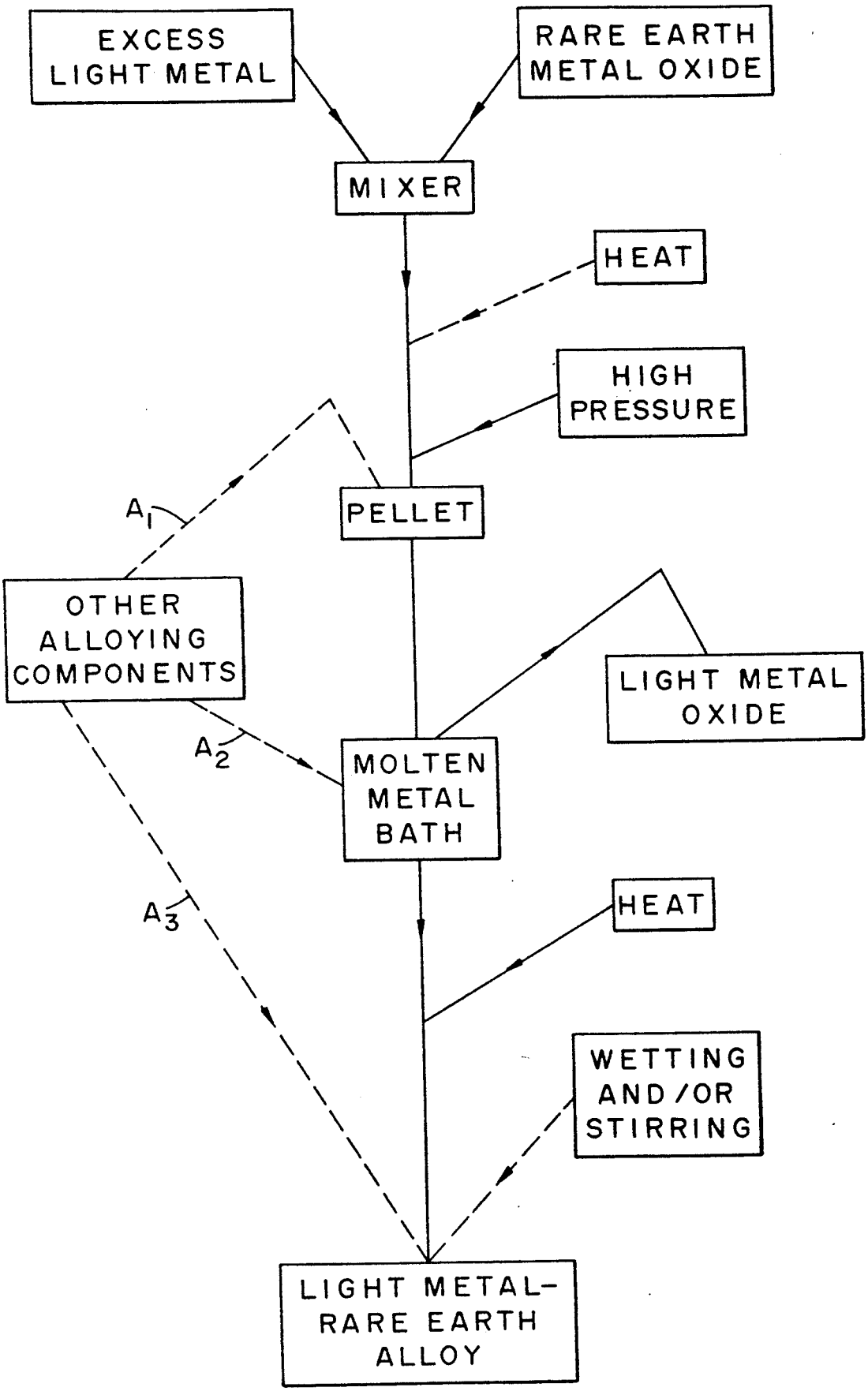
EXCESS LIGHT METAL
RARE EARTH METAL OXIDE
MIXER
HEAT
HIGH PRESSURE
PELLET
A1
OTHER ALLOYING COMPONENTS
LIGHT METAL OXIDE
A2
MOLTEN METAL BATH
A3
HEAT
WETTING AND/OR STIRRING
LIGHT METAL-RARE EARTH ALLOY

METHOD FOR MAKING A LIGHT METAL-RARE EARTH METAL ALLOY

This is a continuation-in-part of application Ser. No. 07/291,505, filed Dec. 29, 1988, and Ser. No. 07/365,840, filed Jun. 14, 1989, now U.S. Pat. Nos. 5,037,608 and 5,059,608 and 5,059,390, respectively, the disclosures of which are fully incorporated by reference herein.

BACKGROUND OF THE INVENTION

This invention relates to the production of light metal alloys having improved combinations of properties. The invention further relates to a method for making light metal-rare earth metal alloys from pellets of light metal powder and a rare earth metal-containing compound. More particularly, the invention relates to a method for reducing pelletized mixtures of light metal and scandium oxide to form master alloys containing scandium metal.

In the field of alloy development, research is continuously conducted on methods for improving the behavioral characteristics of existing aluminum, magnesium and other light metal alloys. Additional research is directed to the development of new alloy compositions having desired property combinations. Aluminum-based alloys are preferred for many nuclear and aerospace applications because of their relatively high strength-to-weight ratios and corrosion resistance. Magnesium-based alloys possess greater strength-to-weight ratios than most aluminum alloys. These alloys could be made more attractive to manufacturers if it were possible to efficiently and economically incorporate rare earth metals into known or newly developed compositions. That is because even trace amounts of rare earth metals improve corrosion resistance levels and other properties. Minor additions of scandium, for example, are known to improve the tensile and yield strengths of aluminum according to U.S. Pat. No. 3,619,181. Scandium additions of up to about 10% also contribute to the superplastic formability of certain aluminum alloys according to U.S. Pat. No. 4,689,090. Still further improvements may be realized by adding rare earth metals to aluminum brazing alloys (as in U.S. Pat. No. 3,395,001); or by metalliding aluminum surfaces with rare earth metals (as in U.S. Pat. No. 3,522,021). According to Russian Patent Nos. 283,589 and 569,638, scandium additions to magnesium-based alloys improve foundry characteristics, corrosion resistance and/or mechanical strengths.

Although rare earth metal additions improve certain light metal alloy properties, they have not been added to aluminum or magnesium on a commercial scale due, in part, to the difficulty and expense of removing rare earths from the ores containing them. Presently known methods for producing "ingot quality" scandium, for example, require steps for converting scandium oxide to $ScF_3$ with hydrofluoric acid, reducing the scandium fluoride to a salt, then vacuum melting scandium metal from this salt. This method is rather costly and inefficient, however. About fifty percent (50%) of the scandium within ores treated by this method is not recovered. The "ingot quality" scandium alloy that is produced thereby usually contains minor amounts of titanium and/or tungsten as well. These metals are absorbed by scandium from the special containers used in the aforementioned recovery method.

In U.S. Pat. No. 3,846,121, an alternative method for producing scandium metal was disclosed. This method consists of firing scandium oxide in air to remove any volatile residues therefrom; chlorinating air-fired scandium oxides with phosgene; then reducing the $ScCl_3$ to magnesium-scandium for subsequent purification by vacuum distillation or arc-melting. Once scandium has been isolated from its ore, it must still be alloyed into one or more metals. Such rare earth metal additions pose their own set of complications. If scandium ingots are directly added to a molten bath of aluminum, scandium aluminide intermetallics tend to form, said intermetallics having melting temperatures hundreds of degrees higher than those associated with aluminum alone. With an increasing presence of these intermetallics, alloy mixing will slow, thereby resulting in an increased chance of producing inhomogenous alloy products.

Several means for directly making light metal-rare earth metal alloys are also known. U.S. Pat. No. 3,855,087, for example, codeposits rare earth metal and aluminum (or magnesium) onto a solid molybdenum, tungsten or tantalum cathode rod by simultaneously reducing oxides of both metals in a molten bath containing LiF and preferred rare earth metal fluorides. The alloy that is produced collects in a non-reactive receptacle placed beneath the cathode rod. In U.S. Pat. No. 4,108,645, a method for making an aluminum-silicon-rare earth metal is claimed which includes reducing rare earth metal oxides with aluminum in the presence of silicon and an alkali metal or alkaline earth metal fluoride flux. The method maintains this flux at a temperature between 1250°-1600° C. West German Patent Application No. 2,350,406 describes a method for producing light metal-rare earth metal master alloys by electrolytically reducing combinations of light metal oxide and rare earth metal oxide in another fluoride salt bath.

In U.S. Pat. No. 3,729,397, there is claimed a method for making magnesium-rare earth metal alloys by reducing rare earth metal oxides in a salt bath with a molten magnesium cathode. After rare earth metal deposits on the cathode confined within a boron nitride sleeve, magnesium-rare earth metal alloy is recovered from this sleeve through ladling, tapping or the like.

French Patent No. 2,555,611 shows a method for reacting rare earth metal oxides with aluminum powder, preferably under an inert gas cover maintained at atmospheric pressure. When a homogeneous mixture of these components is heated at temperatures exceeding 700° C., or well above the melting point for aluminum, an aluminum oxide by-product forms which may be skimmed from the molten alloy surface. In Russian Patent No. 873,692, there is disclosed a method for preparing aluminum-scandium master alloy by combining aluminum powder with scandium fluoride under vacuum in three temperature-increasing stages. This method lowers the fluoride content of the resulting alloy product.

Several means for premixing certain alloying components or subcomponents are also known. U.S. Pat. No. 2,911,297, for example, introduces high melting temperature constituents into molten metal by combining powdered forms of one metal and a salt into a briquette. The salt for this process must be capable of evolving gases at a sufficient pressure for spontaneously disrupting the briquette once it is introduced to the melt. According to the reference, pulverized manganese, copper, nickel or chromium may be added to molten metals by this process.

In U.S. Pat. No. 3,380,820, there is shown a method for making aluminum alloys containing between 2–25% iron. The method includes mixing aluminum with iron particles having a maximum dimension of less than one inch, compressing this mixture into a briquette, and melting the briquette before casting. U.S. Pat. No. 3,503,738 discloses a metallurgical process for preparing aluminum-boron alloys. The process compacts a majority of $KBF_4$ with finely divided aluminum before adding such compacts to a molten aluminum bath. At least some of the fluoborate in these compacts serves as flux for the reaction.

U.S. Pat. No. 3,592,637 claims an improved process for making direct metal additions to molten aluminum. The process commences by blending finely-divided aluminum powder with one or more other metals selected from: Mn, Cr, W, Mo, Ti, V, Fe, Co, Cu, Ni, Cd, Ta, Zr, Hf and/or Ag. The foregoing blends are then compacted to about 65–95% of their maximum theoretical density. In U.S. Pat. No. 4,648,901, aluminum and another metal component are admixed with a flux of potassium cryolite, potassium chloride, potassium fluoride, sodium chloride, sodium fluoride and/or sodium carbonate before being compacted into "tablets".

In U.S. Pat. No. 3,935,004, recovery efficiencies are enhanced by reducing such aluminum alloying components as manganese, chromium and iron to an average particle size of less than about 0.25 mm before pelletizing these particles with up to 2.5% of a non-hygroscopic fluxing salt and binder, if necessary. U.S. Pat. No. 3,941,588 shows still other means for incorporating materials into molten metal. Such alloying metals as manganese or chromium, for example, may be particulated and admixed with flux and a finely divided phenolic. This mixture is then added to molten aluminum as a powder or in lump, bag or briquette form. In U.S. Pat. No. 4,171,215, finely divided beta manganese particles are blended with aluminum powder before compaction into readily usable briquettes.

BRIEF DESCRIPTION OF THE INVENTION

It is a principal objective of this invention to provide efficient and economical means for making light metal-rare earth metal alloys. It is a further objective to provide an improved method for making such alloys from rare earth metal compounds without having to first reduce such compounds to rare earth metal. It is another objective to produce such alloys without the need for substantial salt fluxes. It is still another objective to provide means for reducing rare earth metal oxides and/or halides to make light metal-rare earth metal master alloys therefrom. Such means include pelletizing mixtures of a rare earth metal compound with one or more finely-divided light metals at low to intermediate temperatures and relatively high pressures of about 9 kpsi or more. When pelletizing at ambient temperatures, even fewer handling, processing and/or equipment complications arise due to the elimination of quenching steps or other cool-down delays.

It is another objective to provide means for reducing scandium oxide to scandium and forming magnesium-scandium, magnesium-aluminum-scandium or aluminum-magnesium-scandium alloys therefrom. This invention achieves such objectives in fewer steps than the scandium-reducing methods summarized above. It is practical from a capital investment standpoint since pellet-forming presses from other metallurgical operations may be used herewith. No special distillation equipment is required unlike the various rare earth metal compound reductions described above. After composite pellets are formed according to the invention, such pellets may be added to most any existing, or subsequently developed, molten alloy composition capable of wetting or otherwise reacting with the pellets. Any metal oxide by-product (MgO and/or $Al_2O_3$) that forms may be removed from the melt by conventional or subsequently-developed means. The present invention thus requires no inert, vacuum or other special atmosphere, unlike the reactions of French Patent No. 2,555,611.

It is another principal objective of this invention to provide means for adding rare earth metals, in an oxide form, to most molten light metal baths. It is yet another objective to provide means for alloying scandium into magnesium, or magnesium and aluminum. Another objective provides means for reducing mixtures of light metal powder(s) and rare earth metal compound into stable intermetallics. It is an objective to cause the rare earth metal compounds of these mixtures to reduce within the pellets, rather than in the melt to which such pellets are added. The method of this invention is thus less dependent upon such critical melt-reduction factors as: the temperature of the molten metal to which the pellets are fed; the length of time for which these pellets are exposed to molten metal; the size of the molten metal pool; and the extent to which this pool is mixed after pellet additions thereto. It is still another objective to provide means for producing a magnesium-lithium-aluminum-zinc-manganese alloy having improved property combinations, said alloy being suitable for numerous aerospace applications.

In accordance with the foregoing objects and advantages, there is provided a method for making a light metal-rare earth metal alloy by adding pellets to a substantially flux-free bath of molten light metal, said pellets comprising a blend or mixture of a rare earth metal-containing compound and one or more light metal powders. The invention produces such pellets under relatively high pressures. For powdered aluminum, pressures of about 9 kpsi or more are most appropriate. Preferred pressures for magnesium pelletizing may be higher or lower depending on equipment constraints, component particle sizes and general safety concerns. On a preferred basis, pellets of this invention are added to molten baths of aluminum, magnesium, and their alloys. Pre-pelletizing may also be used to alloy rare earth metal compounds with still other metal alloys. For better reduction efficiencies, blends should be made from light metal powders and rare earth metal compounds which are substantially similar in terms of average or median particle size. The invention is especially useful for making any light metal-scandium alloys which tolerate the presence of at least some aluminum therein.

BRIEF DESCRIPTION OF THE DRAWINGS

Further features, other objects and advantages of this invention will become clearer from the following detailed description of preferred embodiments made with reference to the drawing in which:

FIG. 1 is a flow chart outlining preferred method steps for one embodiment of this invention.

DETAILED DESCRIPTION OF THE PREFERRED EMBODIMENTS

In accordance with the preferred embodiments, there is disclosed a method for making light metal-rare earth metal alloys having improved combinations of properties. The aluminum-based alloys that are produced hereby may contain up to about 35 wt. % rare earth metal, though maximum contents of about 12–15% rare earth are more typical. On a preferred basis, these alloy compositions include about 0.5–10 wt. % rare earth metal. For magnesium-aluminum alloys, the maximum amount of rare earth metal deposited into the molten bath should not exceed about one-third of the total weight percentage of aluminum present. Thus, a molten magnesium bath containing about 6 wt. % aluminum should have no more than about 2 wt. % of one or more rare earth metals added thereto by this method.

The term "light metal" as used herein, shall mean any metal, or metal alloy, having a comparatively low density, typically below about 4 g/cc. Although magnesium and aluminum are representative of such elements, it is to be understood that still other light metals, such as barium, calcium, potassium, sodium, silicon and selenium, may be alloyed in a similar manner. By use of the terms "aluminum" and "magnesium" with reference to metal powders or molten metal bath compositions, it should be further understood that such terms cover both the substantially pure forms of each metal, as well as any alloy having aluminum or magnesium as its main alloying component. It should be especially noted that combinations of these two light metals are covered by the aforementioned terms, so that rare earth metal oxides may be combined with powdered forms of magnesium-aluminum alloys, or with blends of separate magnesium and aluminum powders according to the steps described in more detail hereinafter. The term "substantially flux-free", as used herein, shall mean that only trace or minor amounts of salt fluxes are added to the powder blend before pelletizing. The same term is also used to describe the molten metal bath to which these pellets are added. On a preferred basis, such pellets and baths contain less than 5%, preferably less than about 2%, and more preferably about 1% or less salt flux.

The rare earth metals alloyed with light metal according to the invention include the Lanthanide series of elements from the Periodic Table. This series includes: lanthanum, cerium, praseodymium, neodymium, promethium, samarium, europium, gadolinium, terbium, dysprosium, holmium, erbium, thulium, ytterbium and lutetium. The invention also works well with scandium and yttrium, two other metals commonly grouped with the foregoing metal series because of similar properties and behavioral characteristics. On a preferred basis, this invention works well at combining scandium, yttrium and/or cerium with such light metal alloys as molten magnesium, or magnesium-aluminum alloy baths. It is to be understood, however, that the method of this invention may also be used to add compounds of still other metals, such as zirconium and hafnium, to molten light metals, or to add rare earths to magnesium-based master alloys which further contain such other components as: lithium, zinc, manganese, silicon, iron, nickel, copper and combinations thereof.

The detailed description that follows periodically refers to producing an alloy composition wherein the light metal powder is magnesium and rare earth metal compound consists essentially of scandium oxide. In yet another example, magnesium and aluminum metal powders are blended together with scandium oxide before compaction. Such pellets are then added to a bath of substantially pure (i.e., 99.99%) molten magnesium or to a molten magnesium master alloy bath containing one or more of: lithium, aluminum, zinc, manganese, silicon, iron, nickel and copper. It is to be understood, however, that the foregoing combinations are merely representative of this invention and that still other combinations of light metal-rare earth metal compounds may be alloyed in a like manner.

Referring to accompanying FIG. 1, there is shown the chronological steps for one preferred method of making light metal-scandium master alloy according to the invention. The method commences by providing scandium oxide powder with excess light metal powder in a mixer. After making a substantially homogeneous mixture or blend from these powders, the mixture is compacted into one or more pellets with an application of high pressure. In some instances, heat may be applied during pelletizing to enhance the rate and/or efficiency of compaction. The optional nature of such heating is illustrated by the dotted rather than solid arrow connecting the heating box to flow diagram in FIG. 1, however. When high pressures from about 7 or 9 kpsi to about 15 or 16 kpsi are used for pelletizing at ambient temperatures near about room temperature or slightly higher, such compaction at these lower temperatures contributes significantly to the ease of pellet formation and further processing. Such temperatures eliminate any need for pellet cool-downs and/or extra heat quenching steps. Even higher pressures, above about 16 kpsi, may be employed depending on still other equipment and safety constraints.

After a sufficient number of light metal-$Sc_2O_3$ pellets have been formed, they are fed to a containment of molten light metal, preferably 99.99% pure molten magnesium. Although these pellets contribute scandium as well as some light metal to the bath, typically over 90% of the magnesium in the end product comes from the melt rather than from more costly blends of magnesium or magnesium-aluminum powders. Soon after these pellets dissolve in their bath, a light metal oxide (MgO) by-product begins to form and collect on the surface of the molten metal bath. When aluminum powder exists in the pellet, aluminum oxide ($Al_2O_3$) may also form and rise to the bath surface. It is preferred that such light metal by-products be physically removed from the melt, typically on a periodic basis. Depending on the intended end use of master alloy product, some degree of internal MgO and/or $Al_2O_3$ contamination may be tolerated. For most applications, however, substantially all of these metal oxide by-products should be removed before dilution, casting or further alloying. It is preferred that all molten metal be passed through a filter or other impurity collection means for this very purpose.

If the compacted pellets dissolve more slowly than desired, optional wetting and/or stirring steps may be performed as shown by another dotted arrow step in accompanying FIG. 1. By "pellet wetting", it is meant that at least some pellets may be treated, coated or otherwise handled in some way as to make them more receptive to reacting with molten magnesium (or another light metal alloy). For compacted pellets of Al-$Sc_2O_3$, a common wetting step consists of pushing or holding the pellets which tend to float on the molten light metal surface beneath the surface of the melt until a sufficient amount of molten light metal has coated the pellet surface. Wetting may also be encouraged or enhanced by adding minor amounts of salt flux, preferably about 1% or less, to the light metal-$Sc_2O_3$ mixture before compaction. Minor amounts of flux may also be added, supplementally or alternatively, to the molten light metal bath for enhancing pellet wetting and dissolution. Suitable fluxes for encouraging aluminum-scandium oxide pellet wetting include most metal fluorides and/or chlorides.

The ratio of light metal to scandium oxide (or other rare earth metal compound) plays an important role in the reduction efficiencies of this method. For commercial applications, the molar concentrations of magnesium and/or aluminum to scandium oxide should range from about 30:1 to about 60:1 or more. By weight percent, these same concentrations of light metal to rare earth metal oxide should range from about 7:1 to 15:1, with a preferred ratio being about 9 or 10:1. In any event, light metal powders should be present in sufficient quantities (and size distributions) as to separate virtually every single scandium oxide particle from one another in the compacted pellet. Clearly then, the light metal powders of each pellet should be present as a substantial majority therein. Pellets containing light metal to $Sc_2O_3$ ratios below about 7:1 or above about 15:1 may still react to form light metal, scandium-containing alloy. Such pellet mixtures would be expected to react at lower than commercially practical reaction efficiencies, however.

Relative particle sizes have also been determined to be influential on rare earth metal compound reduction rates by this method. For purposes of pellet homogeneity and improved density, the light metal powders and rare earth metal-containing compounds to be commingled should be substantially similarly-sized (or as close to one another in median particle size as is physically possible). It is believed that when particles of one component are larger than those of any other component(s), the pellet tends to have a greater number of voids therein. Such voids are believed to be detrimental to the reduction reactions that follow since: (i) components do not diffuse across such voids; (ii) the voids contain air that can react with light metal-scandium intermetallics to form undesirable oxides, nitrides and/or oxynitrides; and (iii) any expansion of the gases trapped in a void may cause premature disruption of the pellet.

In preferred embodiments, the ratios of light metal powder to scandium oxide particle sizes range from about 0.5:1 to about 2:1. On a more preferred basis, such particle size ratios range from about 0.75 to about 1.5:1. Theoretically, a 1:1 ratio in particle size for powdered Mg and $Sc_2O_3$ should reduce most efficiently when homogeneously mixed before compaction. Larger Mg powders (with a median particle size of about 50 microns or less) are nevertheless preferred from a safety standpoint due to general volatility or explosiveness of this pellet component.

Without limiting the scope of this invention in any manner, it is believed that light metal particle size affects the overall reduction rates of this method by creating different surface-to-volume ratios for rare earth metal compounds. Any change to this ratio translates to a change in the average diffusion length that a component (reactant) must traverse within its compacted pellet. Average diffusion lengths are much shorter or lower for smaller light particles, therefore. With shorter diffusion distances, scandium oxide particles react more readily thereby speeding up the dissolution of scandium throughout a molten metal bath. The method of this invention is believed to be somewhat diffusion limited. Reduction efficiencies of nearly 100% may be possible following optimization of one or more of the following factors: reactant concentration, diffusion distance and flux rate. For Mg-Sc production by this method, scandium oxide reduction efficiencies of 44%, 55% and 59% were observed for an average reduction efficiency of about 53%. For Mg-Al-Sc alloys, $Sc_2O_3$ reduction efficiencies of 100% were observed on both occasions.

While the inventors do not wish to be bound by any theory of operation, it is believed that their alloying method preferably proceeds for aluminum-scandium alloying by first reducing scandium oxide within the pellet to form a series of aluminum-scandium intermetallics ranging from $Sc_2Al$ to ScAl, $ScAl_2$ and $ScAl_3$. Once these compacted pellets are wetted with molten aluminum, the following reaction is believed to occur:

$$8\ Al + Sc_2O_3 \rightarrow 2\ Al_3Sc + Al_2O_3.$$

Following formation of a stable Al-Sc intermetallic, both aluminum and scandium disperse (or dissolve) throughout the molten metal bath. Of course, rare earth metal dispersal may be further enhanced with homogeneous mixing or periodic bath stirring. When one particular experimental reaction was interrupted before completion, sections of an undissolved pellet were removed from the melt for examination by Guinier X-ray analysis. In this pellet, a clear majority of aluminum metal was detected in combination with about 10–25% $Al_3Sc$, 5–10% $Sc_2O_3$ and about 5–10% ($Al_3O_3N$ and/or $\eta Al_2O_3$).

Suitable means for compressing (or compacting) a mixture of light metal and rare earth metal compound into a pellet include uniaxial cold pressing, isostatic pressing and/or hot pressing. Other suitable extrusion and/or pressing equipment may be substituted for the aforementioned. When such compressed pellets are reacted with molten light metal to form a rare earth metal-containing alloy (or master alloy), it is preferred that most light metal oxide by-product (MgO and/or $Al_2O_3$) be removed from the melt. A majority of this by-product collects on the surface of the molten light metal being alloyed for easy removal by tapping, surface skimming and/or other known means. Nevertheless, all of the molten alloy that is produced should be passed through a filter to assure removal of substantially all undesirable contaminants that might otherwise be suspended within the molten pool or at the base of any molten light metal containment.

The method of this invention is especially suited for making a magnesium-scandium master alloy which may be further alloyed with lithium, aluminum, zinc, manganese and other metals (in powder, liquid or other forms) through known or subsequently-developed techniques to form the various alloys described in Ser. No. 07/365,840. On a preferred basis, the molten magnesium baths to which one adds Mg-$Sc_2O_3$, or Mg-Al-$Sc_2O_3$, pellets are themselves held beneath a non-reactive layer of argon, sulfur hexafluoride and/or other cover gas. This prevents the molten metals (including any lithium therein) from reacting with the atmosphere. Depending on process time, feed materials and/or equipment constraints, some of the foregoing components can be added to the pellet mixtures before compaction as shown by the alternative alloying arrow $A_1$ connecting such alloying components to the main flow of FIG. 1. They may also be alloyed, in whole or in part, to the molten light metal baths before any pellets are added thereto as per alternative arrow $A_2$. If one or more alloying components are absent from, or present in other than desired quantities in either the pellets or the master alloy to which such pellets are added, the necessary quantities of each component may be raised (or lowered through dilution) by known alloying means as per alternative arrow $A_3$. Since alloying practices are not always perfect and alloying compositions may tend to drift away from target over time, it may be necessary to practice alloying alternatives $A_1$, $A_2$ and/or $A_3$ on the same molten metal bath.

The following examples are provided by way of illustration. They are not intended to limit the scope of this invention in any manner, however.

EXAMPLES 1-5

In these examples, powders of: (A) magnesium and scandium oxide, and (B) magnesium, aluminum and scandium oxide were blended together in ratios necessary for achieving a magnesium-based master alloy end product which contains about 2 wt. % by weight scandium for mixture (A), and a 6 wt. % aluminum, 2 wt. % scandium alloy for mixture (B). Each such example was first manually mixed, then tumble mixed. After homogeneous mixing, the respective powder blends of Examples 1-5 were poured into a cylindrical die lubricated with a light lubricating oil. The filled dies were then uniaxially pressed using a Carver Hydraulic Press Model #M, die pressures of about 16 kpsi and temperatures of about 25° C., to produce a sufficient quantity of pellets having a diameter of about 1.125 inch.

To produce scandium-containing magnesium-based alloy with the foregoing pellets, an alumina crucible was first washed with acetone then supplied with 99.99% magnesium before being melted under ambient atmospheric conditions. For most experiments, only about 2 pellets were added to each melt before being physically submerged below the molten metal surface to effect their wetting. The melts were then periodically stirred (at 5-minute intervals) until the pellets completely dissolved therein, usually only after about 30–45 minutes of exposure time. Such procedures resulted in a 1-lb. bench scale melt for each alloy cast. Samples of molten light metal alloy were then removed from each respective melt. Such samples were subjected to compositional analysis by acetylene flame atomic adsorption spectroscopy to show the theoretical amounts of scandium oxide transferred into the melt. Results of such analyses are summarized in the following Table 1:

TABLE 1

| Mixture Sample | Target | Pellet Wt. % Ratio | Final Product Content wt. % Sc | wt. % Al |
|---|---|---|---|---|
| A | | Mg:Sc | | |
| 1 | 2% Sc | 10.2:1 | 0.88 | — |
| 2 | 2% Sc | 10.2:1 | 1.10 | — |
| 3 | 2% Sc | 10.2:1 | 1.19 | — |
| B | | Mg:Al:Sc | | |
| 4 | 6% Al - 2% Sc | 8.5:1.7:1 | 2.07 | 5.85 |
| 5 | 6% Al - 2% Sc | 8.5:1.7:1 | 2.13 | 5.92 |

Having described the presently preferred embodiments, it is to be understood that this present invention may be otherwise embodied within the scope of the appended claims.

What is claimed is:

1. A method for making a light metal-rare earth metal alloy which comprises:

adding a pellet to a substantially flux-free bath of molten light metal, said pellet comprising a blend of a rare earth metal oxide and magnesium metal powder.

2. A method as set forth in claim 1 wherein the rare earth metal of said oxide is selected from the group consisting of: scandium, yttrium, lanthanum, cerium, praseodymium, neodymium, promethium, samarium, europium, gadolinium, terbium, dysprosium, holmium, erbium, thulium, ytterbium, lutetium and combinations thereof.

3. A method as set forth in claim 1 wherein the rare earth metal oxide comprises scandium oxide.

4. A method as set forth in claim 1 wherein the pellet may include aluminum powder and the bath of molten light metal is selected from the group consisting of: magnesium, aluminum and combinations thereof.

5. A method as set forth in claim 1 wherein the light metal powder and molten bath consist essentially of magnesium.

6. A method as set forth in claim 1 wherein the blend includes magnesium powder, aluminum powder and scandium oxide.

7. A method for making a scandium-containing light metal alloy which comprises:

(a) mixing finely divided, scandium oxide with magnesium metal in a powdered form to make a mixture;

(b) forming a pellet from the mixture; and (c) feeding the pellet to a substantially flux-free bath of molten light metal.

8. A method as set forth in claim 7 which further comprises:

(d) removing light metal-containing by-products from the molten bath.

9. A method as set forth in claim 7 wherein the mixture may include aluminum and the bath of molten light metal is selected from the group consisting of magnesium, aluminum and combinations thereof.

10. A method as set forth in claim 7 wherein the mixture includes a magnesium-based alloy powder.

11. A method as set forth in claim 7 wherein the mixture includes up to about 10 wt. % aluminum powder.

12. A method as set forth in claim 1 wherein the scandium oxide and light metal powder(s) of the mixture are substantially similar in medium particle size.

13. A method as set forth in claim 7 wherein step (b) includes:

(i) heating the mixture to one or more temperatures below the lowest melting point of the light metals present in said mixture; and (ii) compacting the mixture under a pressure of about 7 kpsi or more.

14. A method as set forth in claim 7 wherein step (b) comprises: compressing the mixture under a pressure between about 9 and 16 kpsi.

15. A method as set forth in claim 7 wherein the molten bath includes one or more components selected from the group consisting of: lithium, aluminum, zinc, manganese and silicon, with a balance of magnesium and impurities.

16. A method for making a magnesium-scandium master alloy comprises:

(a) providing a mixture of magnesium powder and scandium oxide, the amount of magnesium powder being present as a substantial majority in said mixture;

(b) compacting the mixture into a pellet under high pressure; and (c) adding the pellet to a bath of molten magnesium.

17. A method as set forth in claim 16 which further comprises:

(d) removing magnesium oxide from the bath.

18. A method as set forth in claim 16 wherein the mixture further includes at least about 2% aluminum powder.

19. A method as set forth in claim 16 wherein the weight ratio of magnesium to scandium oxide in the mixture is about 7:1 or greater.

20. A method as set forth in claim 16 wherein the molten bath includes one or more alloying components selected from the group consisting of: lithium, aluminum, zinc, manganese and silicon.

21. A method for making a magnesium-aluminum-scandium or aluminum-magnesium-scandium alloy which comprises:

(a) providing a mixture of magnesium powder, aluminum powder and finely-divided scandium oxide, the amount of magnesium and aluminum powders substantially exceeding the amount of scandium oxide in said mixture;

(b) compacting the mixture into a pellet under a pressure of about 7 kpsi or more; and (c) adding the pellet to a bath of molten magnesium for making the magnesium-aluminum-scandium alloy thereby, or to a bath for making the aluminum-magnesium-scandium alloy thereby.

22. A method as set forth in claim 21 wherein the mixture includes a magnesium-aluminum alloy powder, an aluminum-magnesium alloy powder, or both.

23. A method for making an alloy having improved combinations of strength, formability and corrosion resistance, said alloy comprising: about 7 to 12 wt. % lithium; about 2 to 7 wt. % aluminum; about 0.4 to 2 wt. % of a rare earth metal; up to about 2 wt. % zinc; and up to about 1 wt. % manganese, the balance magnesium and impurities, said method comprising:

(a) providing a pellet which includes a compacted mixture of magnesium powder and rare earth metal oxide, the weight ratio of magnesium powder to rare earth metal oxide in said mixture being about 7:1 or greater;

(b) dissolving the pellet in a bath of molten magnesium; and (c) adding one or more components to the molten bath, said components being: (i) absent from, or present in lower than desired quantities, in either the pellet or molten bath; and (ii) selected from the group consisting of: lithium, aluminum, rare earth metal, zinc, manganese, and mixtures thereof.

24. A method as set forth in claim 23 wherein the pellet further includes up to about 10 wt. % aluminum powder.

25. A method as set forth in claim 23 wherein the rare earth metal oxide comprises scandium oxide.

26. A method as set forth in claim 23 wherein the rare earth metal of the alloy is selected from the group consisting of: scandium, yttrium and cerium.

27. A method as set forth in claim 23 wherein the alloy further contains up to about 5 wt. % silicon and less than about 0.1 wt. % in total impurities, including up to about 0.05 wt. % iron, up to about 0.03 wt. % nickel and up to about 0.05 wt. % copper.

28. A method as set forth in claim 23 wherein the alloy is substantially free of boron, cadmium, hafnium, silver and sodium.

* * * * *